US005458481A

United States Patent [19]

Surbey et al.

[11] Patent Number: 5,458,481

[45] Date of Patent: Oct. 17, 1995

[54] BURNER FOR COMBUSTING GAS WITH LOW $NO_x$ PRODUCTION

[75] Inventors: David J. Surbey; James L. Smith, both of Tulsa; Richard C. Allen, Catoosa; Alan D. Witwer, Tulsa, all of Okla.

[73] Assignee: Zeeco, Inc., Tulsa, Okla.

[21] Appl. No.: 187,172

[22] Filed: Jan. 26, 1994

[51] Int. Cl.[6] ..... F23L 7/00

[52] U.S. Cl. ..... 431/115; 431/175

[58] Field of Search ..... 431/115, 116

[56] References Cited

U.S. PATENT DOCUMENTS

| | | | |
|---|---|---|---|
| 2,174,663 | 10/1939 | Keller | 126/109 |
| 2,918,117 | 12/1959 | Griffin | 158/1 |
| 4,004,875 | 1/1977 | Zink | 431/9 |
| 4,162,140 | 7/1979 | Reed | 431/284 |
| 4,277,942 | 7/1981 | Egnell et al. | 60/517 |
| 4,476,791 | 10/1984 | Cegielski, Jr. | 110/346 |
| 4,483,832 | 11/1984 | Schirmer | 423/210 |
| 4,505,666 | 3/1985 | Martin et al. | 431/175 |
| 5,073,105 | 12/1991 | Martin et al. | 431/116 |
| 5,180,300 | 1/1993 | Hovis et al. | 431/116 |
| 5,284,438 | 2/1994 | McGill et al. | 431/116 |

*Primary Examiner*—Carroll B. Dority
*Attorney, Agent, or Firm*—Head and Johnson

[57] ABSTRACT

A burner for combusting fuel gas and air in an enclosure includes a block member of non-combustible material, such as ceramic material, having a central opening therethrough. The block member has a plurality of spaced apart recirculation gas passageways paralleled to and spaced from the central opening, each of the recirculation gas passageways having an injection passageway communicating with the block member central opening. A fuel gas jet is positioned within each of the recirculation gas passageways for injecting fuel gas into the injection passageways to cause the injected fuel gas by Venturi action, to draw furnace gas from the cool fringes of the combustion zone through the recirculation gas passageways for passage back into the central opening after local combustion wherein modified air and fuel gas are thoroughly mixed and cooled for combustion within the enclosure. This recirculation system serves to reduce the temperature and oxygen content of the local combustion process to thereby reduce $NO_x$ production.

17 Claims, 6 Drawing Sheets

EQUILIBRIUM $NO_x$ CONCENTRATION

*(PRIOR ART)*

ADIABATIC FLAME TEMPERATURE
*(PRIOR ART)*

HEATER ISOTHERMS (°F)
*(PRIOR ART)*

COMBUSTION PROCESS TEMPERATURE AND RELATIVE OXYGEN

BURNER FOR COMBUSTING GAS WITH LOW $NO_x$ PRODUCTION

BACKGROUND OF THE INVENTION

This invention relates to a burner for combusting air and fuel gas characterized in that the gas is thoroughly mixed on a local basis with modified combustion air in a manner so that resultant combustion is complete and oxides of nitrogen ($NO_x$) in the exhaust gas are substantially reduced.

Fuel gas is burned by mixing air with it, oxygen from the air being combined with carbon and hydrogen present in the gas with the release of substantial heat. If gas is thoroughly mixed with air and combustion is carried out under ideal conditions the results of the combustion are primarily carbon dioxide and water in vapor form. These components are commonly found in the atmosphere and are essentially free of hazard to the environment. However, when a gas is burned in a high temperature, excess air environment, a portion of the nitrogen, which makes up a major component of the atmosphere, will react with oxygen in the atmosphere to produce oxides of nitrogen ($NO_x$). It is well known that, other conditions being equal, $NO_x$ production increases as the temperature of the combustion process increases. Oxides of nitrogen gases are considered to be an environmental hazard.

The present invention is an improved burner for combusting fuel gas with modified air in a manner to result in less $NO_x$ than is available by the present generation of burners. The present generations of burners are commonly referred to as "Low $NO_x$ Burners" or "Low $NO_x$ Burners".

SUMMARY OF THE INVENTION

The present invention is formed by a hollow cylindrical block (burner block) normally formed of ceramic material. The burner block has an inlet and an outlet end. The outlet end is positioned in communication with the interior of an enclosure to be heated by burning gas. The enclosure may be such as a fired heater boiler, furnace or the like. The objective of the burner is to cause combustion of fuel gas in a low temperature modified air environment to thereby reduce the generation of $NO_x$.

The burner block has a plurality of recirculation gas passageways spaced apart and extending a portion of and/or the full length of the burner block between the block inlet and outlet ends. The recirculation gas passageways are paralleled to and spaced from the center line of the cylindrical block. Each of the recirculation gas passageways has connected to it an injection passageway communicating each recirculation gas passageway with the central opening.

A primary fuel gas jet tip is positioned within each of the recirculation gas passageways for injecting fuel gas into the injection passageways. This causes the injected fuel gas to pass into the central opening where it is mixed with air. In addition, cool furnace gas, i.e. recycle gas, is drawn through the recirculation gas passageways for passage back to the injection passageways where it mixes with the fuel and then the mixture combines with air in the central opening.

Thus, the design of the recirculation gas passageways and the injection passageways in conjunction with the orientation of a fuel gas jet positioned in each of the recirculation gas passageways causes the recycle gas to thoroughly mix and intimately combine with the fuel gas causing a reduction in the temperature at which combustion takes place. Under the above conditions the resultant combustion is complete without the production of excessive oxides of nitrogen.

Positioned within the central opening are gas directors. The gas directors are adjacent the central opening and in alignment with each of the injection passageways. The gas directors are arranged to separate the local combustion of the fuel gas mixed with recycle gas from the main body of air and to cause a mixing action of the local combustion products before passing into the central opening. The gas directors are positioned adjacent the central openings so that the center part of the central opening remains unobstructed for the free passage of the main body of air therethrough.

Secondary fuel jet openings are also provided in the burner block. The openings are parallel to and spaced between the recirculation gas passageways. Each secondary fuel jet opening in the burner block has a fuel gas conduit having affixed at the end thereof a gas jet tip extending slightly beyond the outlet end surface of the block and arranged to inject fuel gas across the burner block outlet end surface in a plurality of directions.

The burner block is preferably formed of two portions, that is, an inlet cylindrical portion and a frustoconical outlet portion having an angle ranging from outwardly diverging to inwardly converging. The inlet cylindrical portion outlet is in communication with the frustoconical outlet portion inlet.

A tubular skirt is concentrically positioned adjacent the inlet end of the block and provides means for controlling the passage of air into the burner block central opening.

A fuel gas manifold is positioned in close proximity to the tubular skirt and provides means for communication with each of the fuel gas conduits extending to the gas jet tips. The manifold has a fuel gas supply conduit extending from it.

The burner is configured to extend within the confines of an enclosure of the types previously mentioned. A ceramic insulating material may be provided between the enclosure and the burner block to a depth of at least substantially equal to the length of the burner block.

BRIEF DESCRIPTION OF THE DRAWINGS

FIG. 3 is a reproduction of a drawing taken from U.S. Pat. No. 4,476,791.

FIG. 5 is an end view of the improved burner of this invention as it would be seen from the inside of an enclosure, such as a fired heater, a boiler, a furnace or the like.

DETAILED DESCRIPTION OF THE PREFERRED EMBODIMENTS

Before discussing the improved burner for combusting fuel gas in a low temperature/modified air environment with low $NO_x$ production which is the subject of this disclosure, some background information will be helpful to enable the reader to fully understand the important concepts of the new burner.

Figure 1:
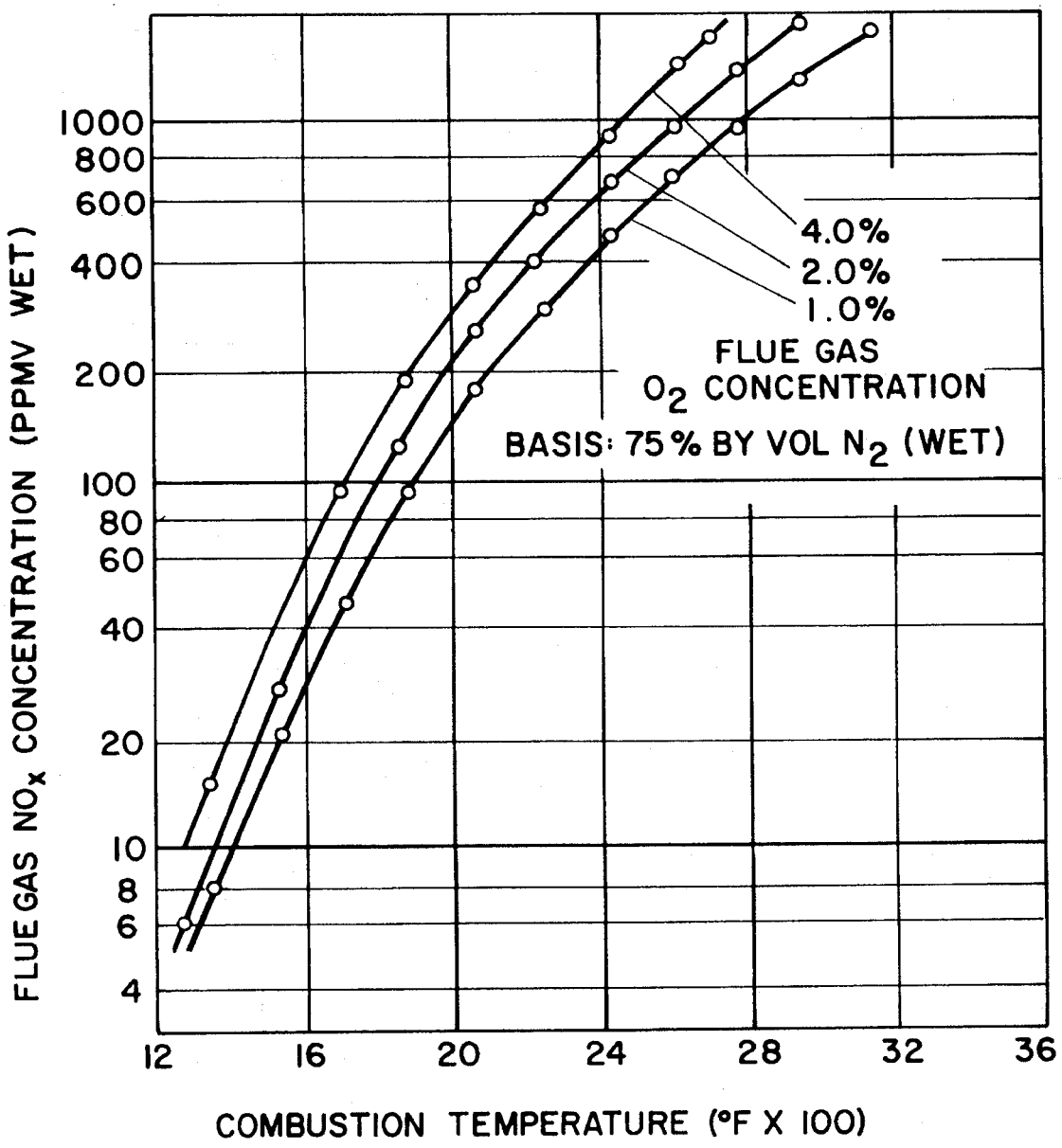
FIG. 1 is a graph showing flue gas equilibrium $NO_x$ concentration versus combustion temperatures under varying flue gas $O_2$ concentrations.

FIG. 1, entitled "Equilibrium $NO_x$ Concentration", illustrates the relationship between flue gas $NO_x$ concentration and the two parameters: (a) combustion temperature and (b) flue gas oxygen concentration. The flue gas $NO_x$ concentration is shown to increase as $O_2$ concentration increases at a fixed combustion temperature and as combustion temperature increases at a fixed $O_2$ concentration. The graph also illustrates that the inverse is also true, that is, as both combustion temperatures and $O_2$ concentrations decrease in value, so does flue gas $NO_x$ concentrations at a fixed $O_2$ concentration and combustion temperature respectively.

Figure 2:
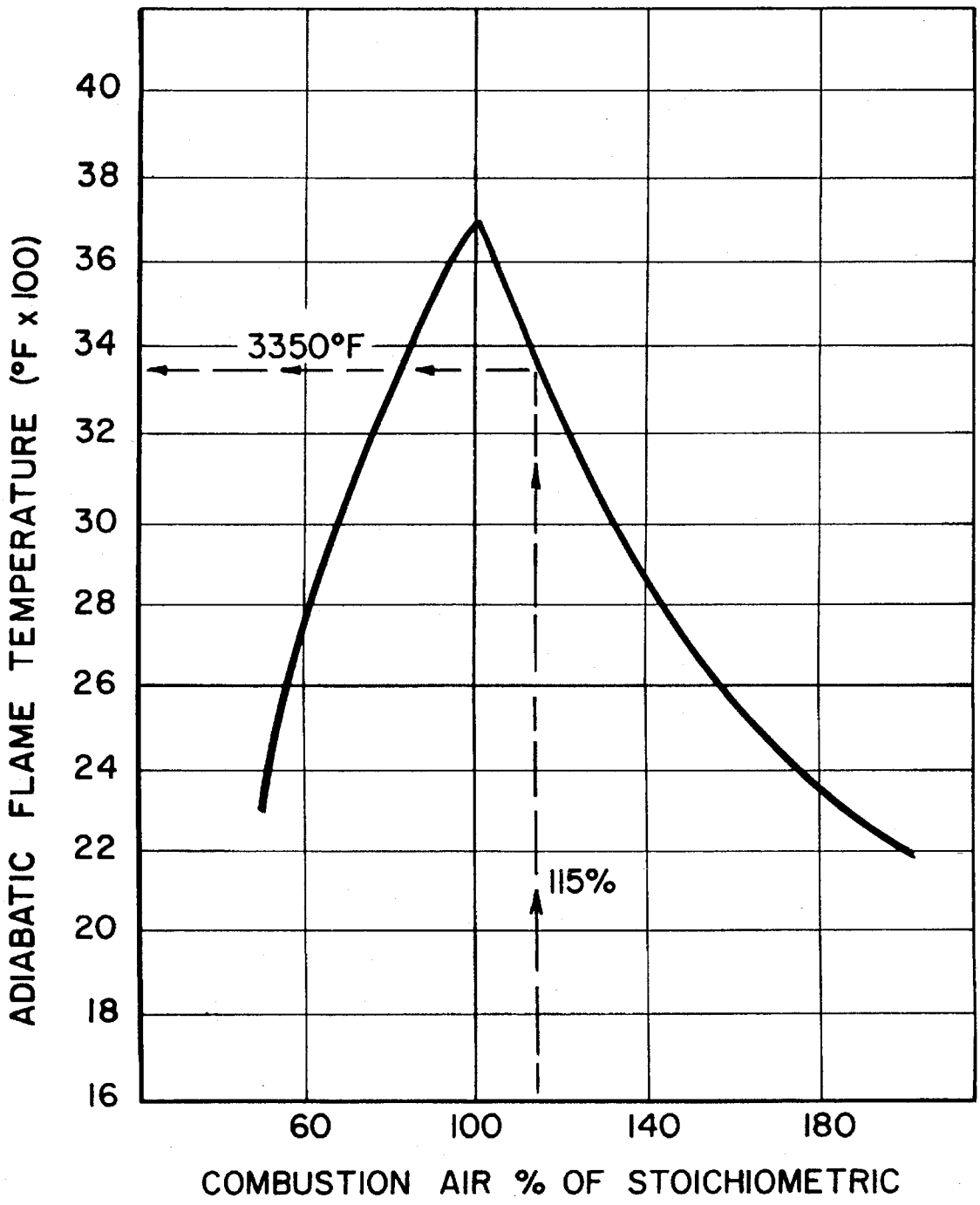
FIG. 2 is a graph showing the relationship in a burner of the adiabatic flame temperature versus the combustion air as a percentage of stoichiometric air.

It must be noted that in this graph $NO_x$ values given are equilibrium values which are never achieved in a real, short time duration, combustion process. For example, the combustion of methane with 15% excess combustion air (115% of stoichiometric) produces a theoretical adiabatic flame temperature of approximately 3350° F. as shown by FIG. 2 entitled "Flame Temperature". A 15% excess combustion air rate results in a flue gas oxygen concentration of approximately 2.5% on a wet basis. Using these parameter values in FIG. 1 results in an off scale reading which means the flue gas $NO_x$ concentration exceeds 1000 PPMV.

Actual flue gas $NO_x$ concentrations are much less than 1000 PPMV, because an equilibrium concentration is never achieved. The kinetics for the $N_2+O_2 \rightarrow NO_x$ chemical reaction is slow, relative to that required for equilibrium. However, it should be noted that as the temperature of the combustion process increases, the difference between equilibrium and actual flue gas $NO_x$ concentration decreases.

A 15% excess combustion air rate, or thereabouts, is close to a minimum value required for efficient burning of the combustible components of the fuel gas. This threshold valve will ensure that the Hydrogen ($H_2$) in the fuel gas will convert to $H_2O$ and the Carbon (C) to $CO_2$, which means that the concentration of unburned Hydrocarbon (UHC) and Carbon Monoxide (CO) in the flue gas will be environmentally safe.

Combustion of fuel gas should occur at the lowest possible temperature to reduce $NO_x$ production. Use of a cooling medium, such as steam, water, or recycle gas can be employed to lower the combustion temperature. However, both water and steam decrease the amount of heat available for heat recovery.

Figure 3:
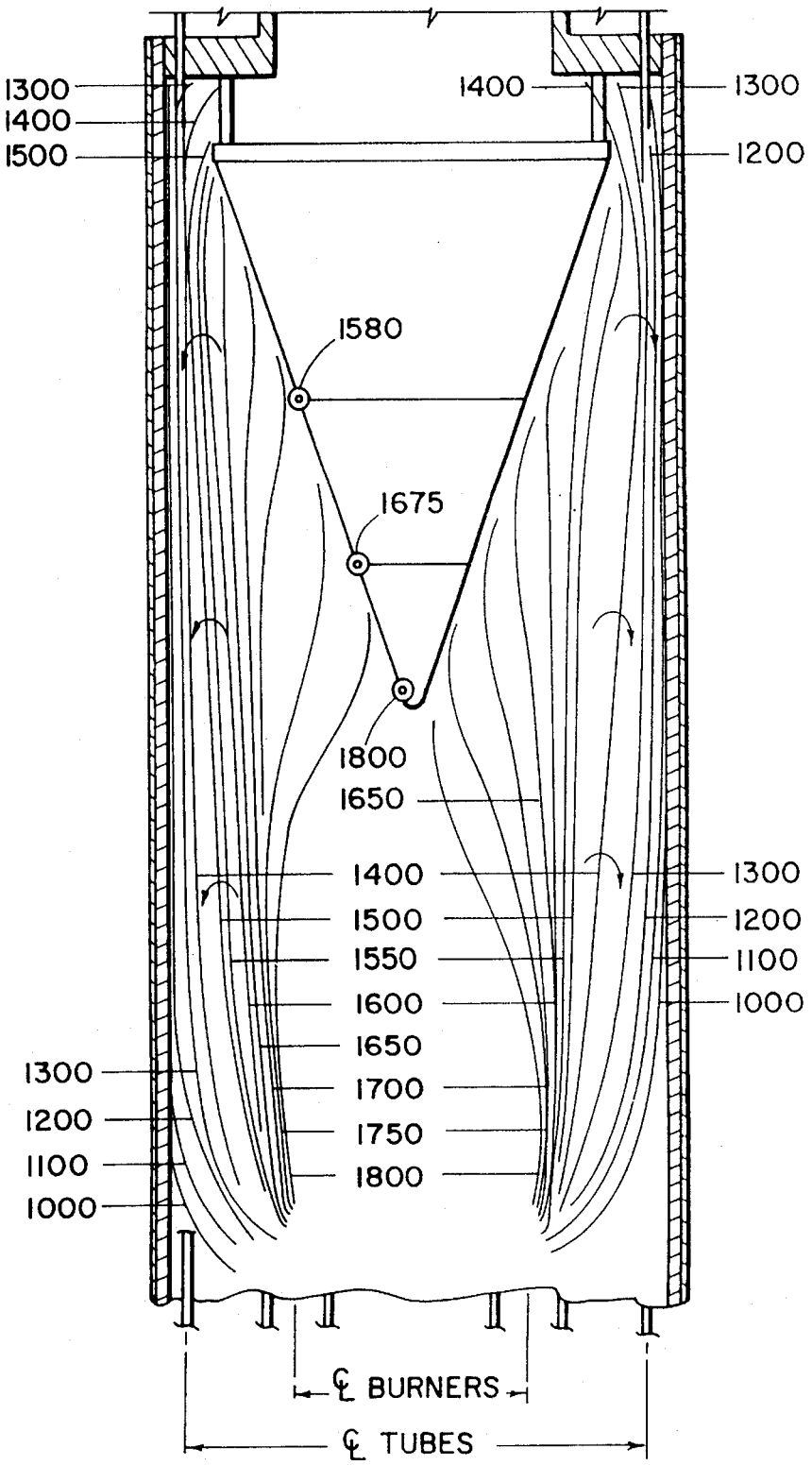
FIG. 3 is a cross-sectional view of a typical burner application showing the relative temperatures within a heat recovery enclosure illustrated by isotherms in degrees Farenheit. This Figure shows how temperatures can vary widely at different locations therein.

FIG. 3 is a schematic showing heater flue gas isotherms and is an example of the temperature profile present in a fired heat recovery enclosure such as those discussed. This Figure is taken from U.S. Pat. No. 4,476,791 which is incorporated herein by reference. Note that in the area of the burner(s), flue gas at a temperature of approximately 1000° F. is present for use to cool the combustion process. Additionally, it should be noted that the addition of this flue gas (containing substantially less than 21% $O_2$ ) to the combustion process would reduce the oxygen present in the local (primary) combustion process, but not the overall excess air ($O_2$ ) in the entire combustion process.

Figure 4:
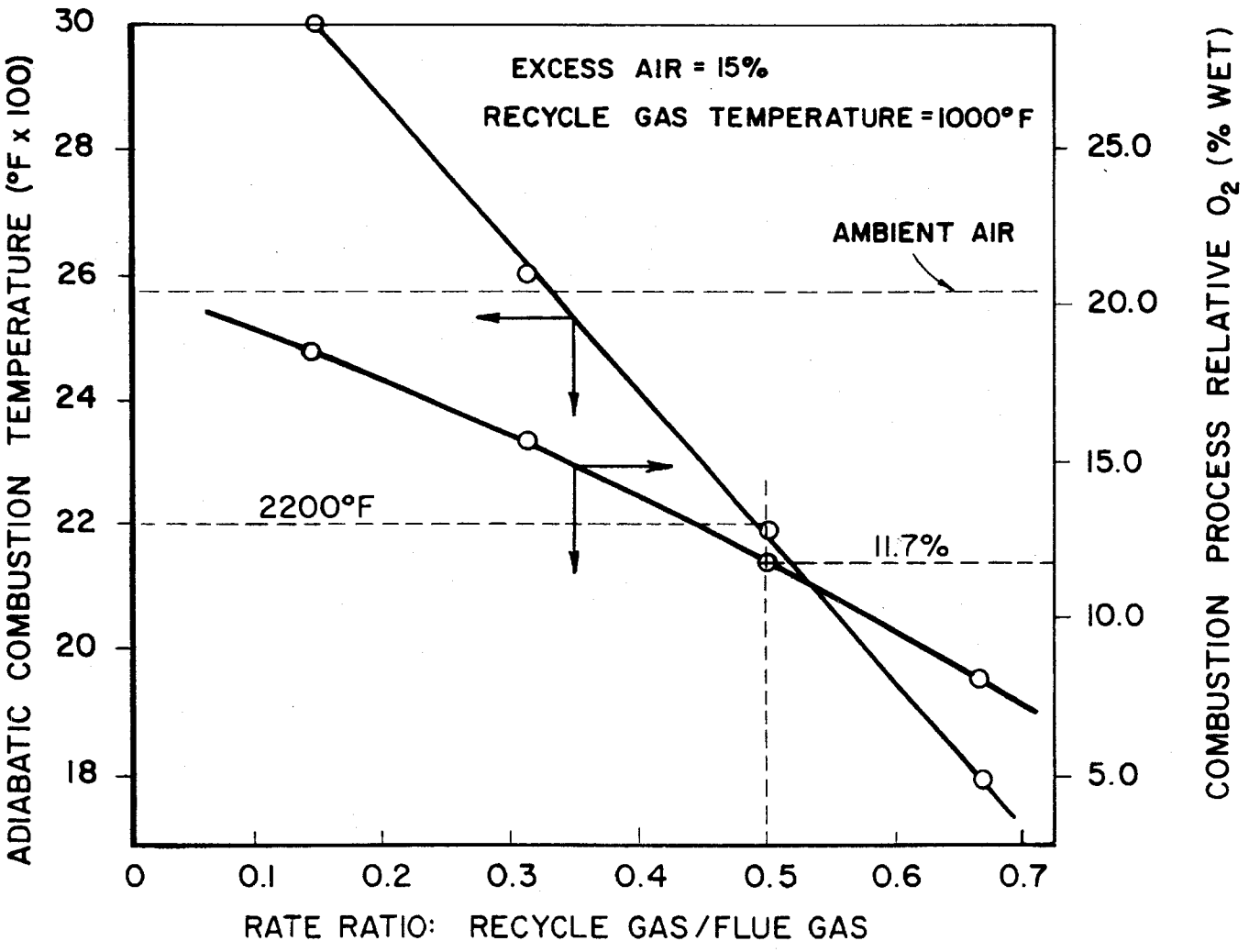
FIG. 4 is a graph showing adiabatic combustion process temperature and relative oxygen as a function of the rate ratio of recycle gas to flue gas.

FIG. 4 entitled "Combustion Process Temperature And Relative Oxygen" is a plot of adiabatic combustion temperature and combustion process relative $O_2$ versus the rate ratio of recycle gas to flue gas. This figure suggests that in designing a burner it is appropriate to decrease the combustion temperature to achieve the required equilibrium $NO_x$. However, the amount of cooling, such as provided by recycle gas, is limited because a flame zone that becomes "to cold" will cease to support combustion. This minimum temperature is approximately 2200° F., which limits the minimum equilibrium $NO_x$.

FIG. 4 shows the effect of the ratio of recycle gas rate to flue gas rate on combustion temperature and relative $O_2$ concentration. The relationship is that as the portion of recycle gas increases, both the temperature and relative $O_2$ of the combustion process decreases. For example, the combustion process temperature is approximately 2200° F. and the amount of $O_2$ present in the combustion process is approximately 11.7% on a wet basis for a recycle gas ratio of 0.5, as opposed to 21% in normal combustion air with no recycle.

With this background which illustrates the major parameters that affect the production of $NO_x$ during gas combustion, reference will now be made to FIGS. 5 and 6 that illustrate the improved burner of this disclosure.

The improved burner, with its swirling, turbulent, segmented, and detached combustion causes maximum flame stability, allowing the local combustion process to occur at a lower temperature and with less concentration of $O_2$ than the current generation of low $NO_x$ burners.

Figure 5:
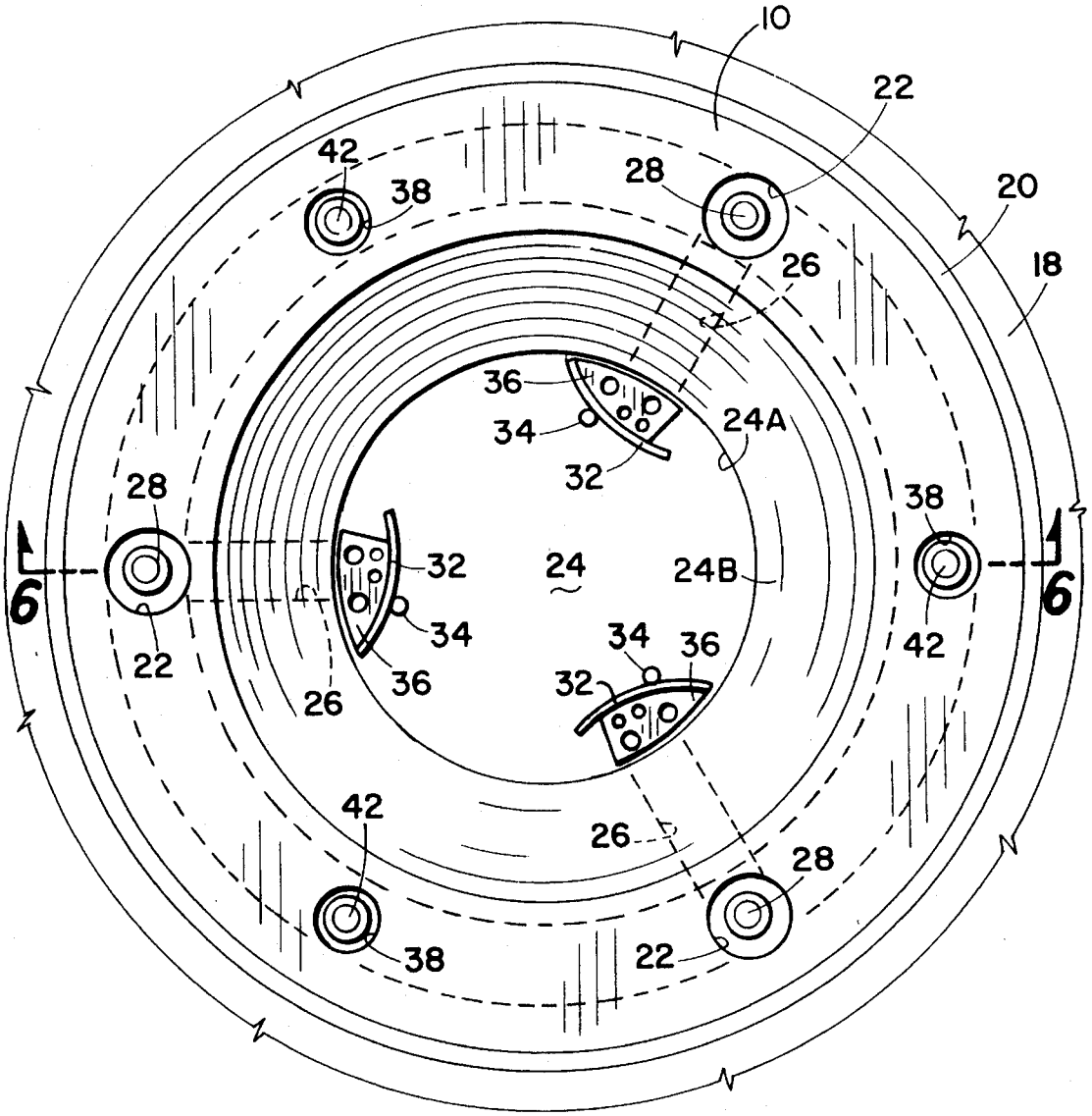
Figure 6:
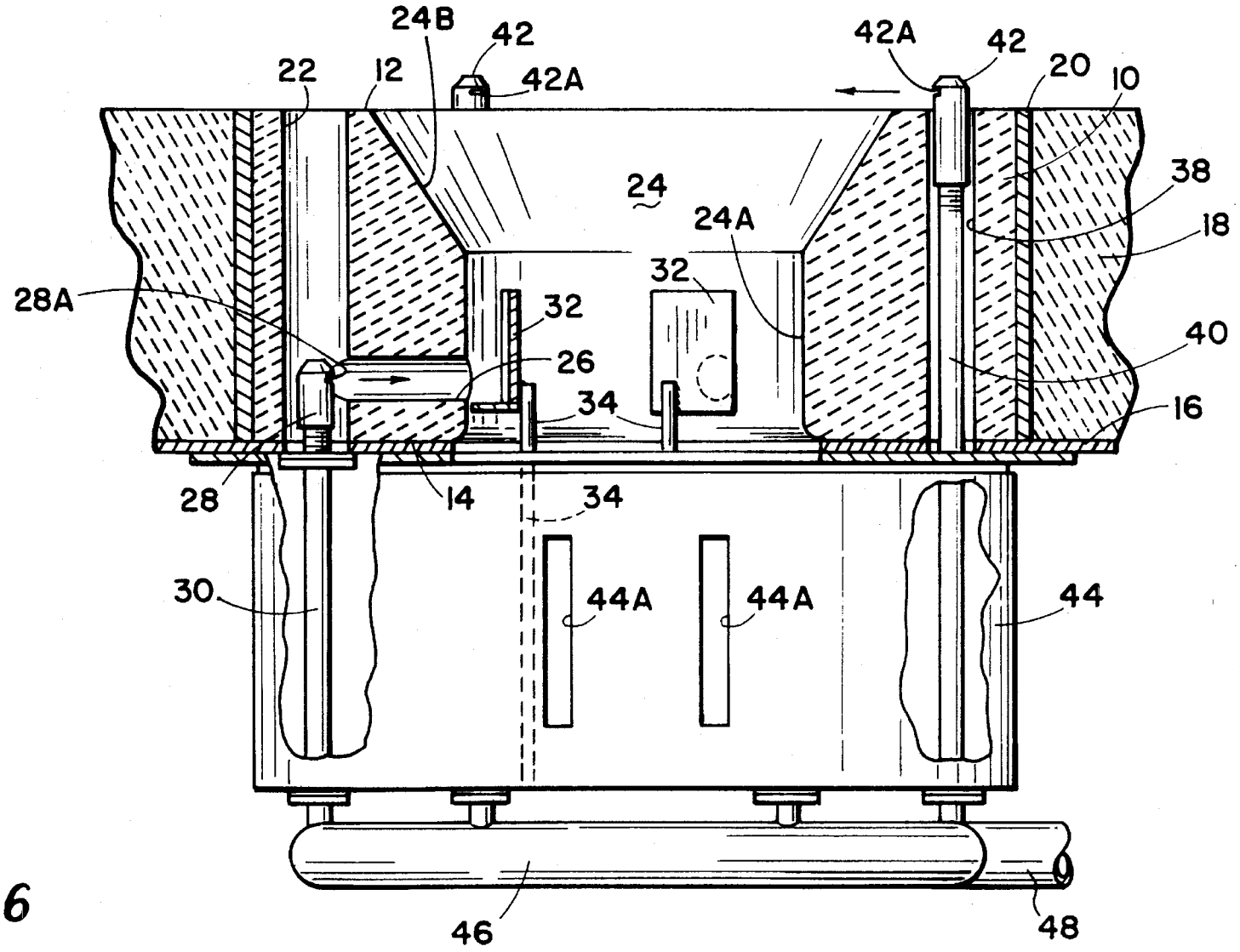
FIG. 6 is a cross sectional view of the burner as taken along the line 6—6 of FIG. 5.

Referring to FIGS. 5 and 6, a burner block is indicated by the numeral 10. Block 10 is preferably formed of a ceramic material, that is, a material that will stand high temperatures without deterioration. Burner block 10 has a outlet end 12 and an inlet end 14. Outlet end 12 is in communication with the interior of an enclosure in which combustion takes place. In the embodiment shown in FIG. 6, the enclosure is shown with a wall 16 that may be formed of metal. Insulating material 18 is secured to the interior of wall 16. In the illustrated arrangement, insulating material 18 is of a thickness equal to that of burner block 10. While the equal thickness of the insulating material and burner block may be considered a preferred arrangement, this does not mean that the burner must be employed in an environment in which insulating material is equal to the thickness of the block, as the block could project into the interior of the enclosure wherein combustion occurs. Block 10 is not limited to being of a cylindrical configuration, and for structural support of the burner block a metal sleeve 20 may be employed. And for protection from thermal compression, a compression layer may be employed between the burner block and the insulating material 18 of the enclosure.

Formed in the block are a plurality of recirculation gas passageways 22. In the embodiment illustrated there are three such recirculation gas passageways, although the number can vary according to the diameter of the block. These recirculation gas passageways are spaced from and paralleled to a central opening 24 formed in the block. Central opening 24 is preferably formed of two parts as illustrated, that is, a first cylindrical portion 24A that communicates with block inlet end 14 and a second frustoconical (which could also be cylindrical) portion 24B that communicates with block outlet end 12.

Each of the recirculation gas passageways 22 communicates with an injection passageway 26. Specifically, each injection passageway 26 communicates at one end with a recirculation gas passageway 22 and at the other end with the central opening 24.

Positioned within each of the recirculation gas passageways 22 is a primary fuel gas jet tip 28 connected to a conduit 30. Each primary fuel gas jet tip 28 has a jet opening(s) 28A oriented to direct gas into the injection passageway 26. Primary fuel gas jet tips 28 inject fuel gas through injection passageway 26 into central opening 24 wherein the fuel gas is mixed with recycle gas and this mixture is then mixed with air to provide a combustible mixture that is burned within the enclosure.

Supported within central opening 24, and specifically within the cylindrical portion 24A of the passageway, are a plurality of gas directors 32, there being a gas director 32 for each of the injection passageways 26. Each gas director 32 is formed of an outwardly extending preferably arcuate curved plate, as seen best in FIG. 5. The gas directors are positioned to intersect gas passing out of the injection passageways and to cause the gas to move in a turning direction within central opening 24. Each gas director 32 is supported by a rod 34 or like device. In addition, a perforated bottom plate 36 serves to augment the outward mixing motion of air and gas within central opening 24.

Fuel gas injected into the injection passageway 26 causes, by the Bernoulli effect, the recirculation of gases from the interior of the enclosure through recirculation gas passageways 22, the recirculated gas passing with the injected fuel gas through injection passageways 26 and into burner block central opening 24. These recirculation gases are from the outer fringes of the combustion zone, which are cooler and serve to minimize combustion temperature and thereby minimize the amount of $NO_x$ production.

Formed within block 10 are spaced apart secondary fuel gas jet tip passageways 38, there being three such openings in the illustrated embodiment. These passageways are spaced from and paralleled to central opening 24 and are also spaced from and paralleled to recirculation gas passageways 22. In the preferred arrangement as illustrated, secondary fuel gas jet tip passageways 38 are interspaced between the recirculation gas passageways 22.

Positioned in each of the staged fuel gas jet tip passageways 38 is a fuel gas conduit 40 having at the upper end thereof a fuel gas jet tip 42. Each of the tips 42 has a jet opening(s) 42A oriented to direct fuel gas into the enclosure at a selected angle. One example of such selected angle is indicated by the arrow across the outlet end 12 of block 10 in the direction towards central opening 24.

In the operation of the burner of this invention, air is drawn through central opening 24 so that air passes from the exterior of the enclosure to the interior and as it passes into the interior, is thoroughly admixed with fuel gas by the burner so that substantially complete combustion occurs within the enclosure. To control air into and through central opening 24, a tubular skirt 44 is provided, the skirt being concentric with central opening 24. The skirt has openings 44A therein to permit passage of air into the interior of the skirt and thence into central opening 24.

Positioned below tubular skirt 44 is a fuel gas manifold 46 which is shown toroidal in shape and is in communication with conduits 30 and 40. A gas supply conduit 48 extends from the manifold to a gas source.

The means of directing air through the burner is not specifically illustrated since such is standard procedures in the industry. For one example of a method of directing air through a burner, reference may be had to U.S. Pat. No. 5,073,105 entitled "Low $No_x$ Burner Assemblies". This patent provides a burner in the same environment as the present invention, but it functions in a different way from the present invention.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A low $NO_x$ burner for combusting fuel gas and air in an enclosure comprising:

a burner block having an inlet end and an outlet end and a central opening therethrough between the ends, the burner block outlet end being in communication with an enclosure to be heated by burning fuel gas, and the block having a plurality of spaced apart recirculation gas passageways extending between said inlet and outlet ends, the gas passageways being at least generally paralleled to and spaced from said central opening and having an injection passageway communicating each gas recirculation passageway with said central opening;

gas director means positioned within said central opening in said block in alignment with said injection passageways; and a fuel gas jet positioned within each said recirculation gas passageway for injecting fuel gas into said injection passageway to cause the injected gas to mix with recycled gas within said injection passageway to provide a fuel gas/recycled gas mixture, recycled gas being drawn through said recirculation gas passageways for recirculation back through said injection passageways into said central opening for mixing with and cooling a fuel/air mixture therein to thereby reduce the production of oxides of nitrogen.

2. A low $NO_x$ burner for combusting fuel gas and air in an enclosure comprising:

a burner block having an inlet end and an outlet end and a central opening therethrough between the ends, the burner block outlet end being in communication with an enclosure to be heated by burning fuel gas, and the block having a plurality of spaced apart recirculation gas passageways extending between said inlet and outlet ends, the gas passageways being at least generally paralleled to and spaced from said central opening and having an injection passageway communicating each gas recirculation passageway with said central opening;

gas directors positioned within said central opening in said block in alignment with said injection passageways, each gas director means being oriented to support primary combustion and to cause mixing action of gas and air passing into said central opening; and a fuel gas jet positioned within each of said recirculation gas passageways for injecting fuel gas into said injection passageways to cause the injected gas to mix with recycled gas within said injection passageways to provide a fuel gas/recycled gas mixture that impinge upon said gas directors, recycled gas being drawn through said recirculation gas passageways for recirculation back through said injection passageways into said central opening for mixing with and cooling a fuel/air mixture therein to thereby reduce the production of oxides of nitrogen.

3. A low $NO_x$ burner for combusting fuel gas and air in an enclosure according to claim 2 wherein said block has a plurality of spaced apart secondary fuel gas jet openings therein extending between said inlet and outlet ends, being at least generally paralleled to and spaced from said central opening;

a gas conducting conduit received in each of said secondary fuel gas jet openings; and a secondary fuel jet member affixed to each said conduit and extending slightly beyond said outlet end of said block and having means to inject gas across said outlet end of said block in a plurality of directions.

4. A low $NO_x$ burner for combusting fuel gas and air in an enclosure according to claim 3 wherein said secondary fuel gas jet openings and said recirculation gas passageways are alternately spaced in at least generally paralleled relationship with each other.

5. A low $NO_x$ burner for combusting fuel gas and air in an enclosure according to claim 2 wherein said central opening in said block is defined by a first substantially cylindrical portion communicating with said block inlet end and a second concentric portion communicating with said block outlet end.

6. A low $NO_x$ burner for combusting fuel gas and air in an enclosure according to claim 5 wherein said second concentric portion of said central opening in said block is frustoconical.

7. A low $NO_x$ burner for combusting fuel gas and air in an enclosure according to claim 2 wherein said block has a cylindrical external surface and including:

a tubular skirt member supported at said block inlet end concentrically with said block central opening and of diameter at least substantially equal to said block cylindrical external surface.

8. A low $NO_x$ burner for combusting fuel gas and air according to claim 7 wherein said tubular skirt member has a plurality of spaced apart air admitting openings therein.

9. A low $NO_x$ burner for combusting fuel gas and air according to claim 3 including:

a gas manifold positioned in close proximity to and spaced from said burner block inlet end and wherein each of said fuel jet members has communication with said gas manifold.

10. A low $NO_x$ burner for combusting fuel gas and air in an enclosure according to claim 1 wherein said director means are oriented to support local primary combustion and then to cause a mixing action of gas and air passing into said central opening.

11. A low $NO_x$ burner for combusting fuel gas and air in an enclosure according to claim 1 wherein said block has a plurality of spaced apart secondary fuel gas jet openings therein extending between said inlet and outlet ends, being at least generally paralleled to and spaced from said central opening;

a gas conducting conduit received in each of said secondary fuel gas jet opening; and a secondary fuel jet member affixed to each said conduit and extending slightly beyond said outlet end of said block and having means to inject gas across said outlet end of said block in a plurality of directions.

12. A low $NO_x$ burner for combusting fuel gas and air in an enclosure according to claim 11 wherein said secondary fuel gas jet openings and said recirculation gas passageways are alternately spaced in at least generally paralleled relationship with each other.

13. A low $NO_x$ burner for combusting fuel gas and air in an enclosure according to claim 11 wherein said central opening in said block is defined by a first substantially cylindrical portion communicating with said block inlet end and a second concentric portion communicating with said block outlet end.

14. A low $NO_x$ burner for combusting fuel gas and air in an enclosure according to claim 13 wherein said second concetric portion of said central opening in said block is frustoconical.

15. A low $NO_x$ burner for combusting fuel gas and air in an enclosure according to claim 11 wherein said block has a cylindrical external surface and including:

a tubular skirt member supported at said block inlet end concentrically with said block central opening and of diameter at least substantially equal to said block cylindrical external surface.

16. A low $NO_x$ burner for combusting fuel gas and air according to claim 15 wherein said tubular skirt member has a plurality of spaced apart air admitting openings therein.

17. A low $NO_x$ burner for combusting fuel gas and air according to claim 4 including:

a gas manifold positioned in close proximity to and spaced from said burner block and wherein each said fuel gas jet has communication with said gas manifold.

* * * * *